US008198537B2

(12) United States Patent
Zhou

(10) Patent No.: US 8,198,537 B2
(45) Date of Patent: Jun. 12, 2012

(54) FOLDABLE ELECTRIC CORD AND ELECTRICAL CONNECTING DEVICE USING THE SAME

(75) Inventor: Yuan-Yuan Zhou, Shenzhen (CN)

(73) Assignees: Shenzhen Futaihong Precision Industry Co., Ltd., ShenZhen, Guangdong Province (CN); Chi Mei Communication Systems, Inc., Tu-Cheng, New Taipei (TW)

( * ) Notice: Subject to any disclaimer, the term of this patent is extended or adjusted under 35 U.S.C. 154(b) by 166 days.

(21) Appl. No.: 12/548,050

(22) Filed: Aug. 26, 2009

(65) Prior Publication Data

US 2010/0218971 A1 Sep. 2, 2010

(30) Foreign Application Priority Data

Feb. 27, 2009 (CN) ..... 2009 1 0300602

(51) Int. Cl.
*H01B 7/08* (2006.01)

(52) U.S. Cl. ..... 174/117 F; 174/117 FF

(58) Field of Classification Search ..... 174/117 F, 174/117 FF
See application file for complete search history.

(56) References Cited

U.S. PATENT DOCUMENTS

| | | | | |
|---|---|---|---|---|
| 4,066,840 | A * | 1/1978 | Allgaier | 174/72 R |
| 4,847,443 | A * | 7/1989 | Basconi | 174/32 |
| 6,111,202 | A * | 8/2000 | Martin | 174/110 R |
| 6,166,332 | A * | 12/2000 | Farrow et al. | 174/135 |
| 6,822,166 | B2 * | 11/2004 | James et al. | 174/93 |
| 2007/0279072 | A1 | 12/2007 | Fagrenius et al. | |
| 2009/0314515 | A1 * | 12/2009 | Bevirt et al. | 174/110 R |

FOREIGN PATENT DOCUMENTS

JP 6-309933 A 11/1994

* cited by examiner

*Primary Examiner* — Chau Nguyen
(74) *Attorney, Agent, or Firm* — Altis Law Group, Inc.

(57) ABSTRACT

A foldable electric cord includes a flexible insulated strap, a wire in the flexible strap. The flexible strap includes at least one first fixing member and at least one second fixing member formed thereon. The first fixing member may be fixed to the second fixing member, to fold the flexible strap at least one time. An electrical connecting device including the foldable electric cord is also disclosed.

19 Claims, 7 Drawing Sheets

FOLDABLE ELECTRIC CORD AND ELECTRICAL CONNECTING DEVICE USING THE SAME

BACKGROUND

1. Technical Field

The present disclosure relates to electric cords, and particularly, to a foldable electric cord used in an electrical connecting device.

2. Description of Related Art

A conventional electric cord includes an elongated insulated housing, and an elongated metallic thread packaged in the insulated housing. Some electrical connecting devices, such as power cables, or charging cables, use the electric cord to transmit signals or power. Typically, the relatively long electric cord is normally coiled or bounded randomly. Some cautious users may tie the electric wire up with a binding line. However, under such circumstances, the electric cord may become tangled and inconvenient to untangle. Furthermore, the metallic thread in the electric cord may break/snap if the cord is not bundled properly.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Figure 1:
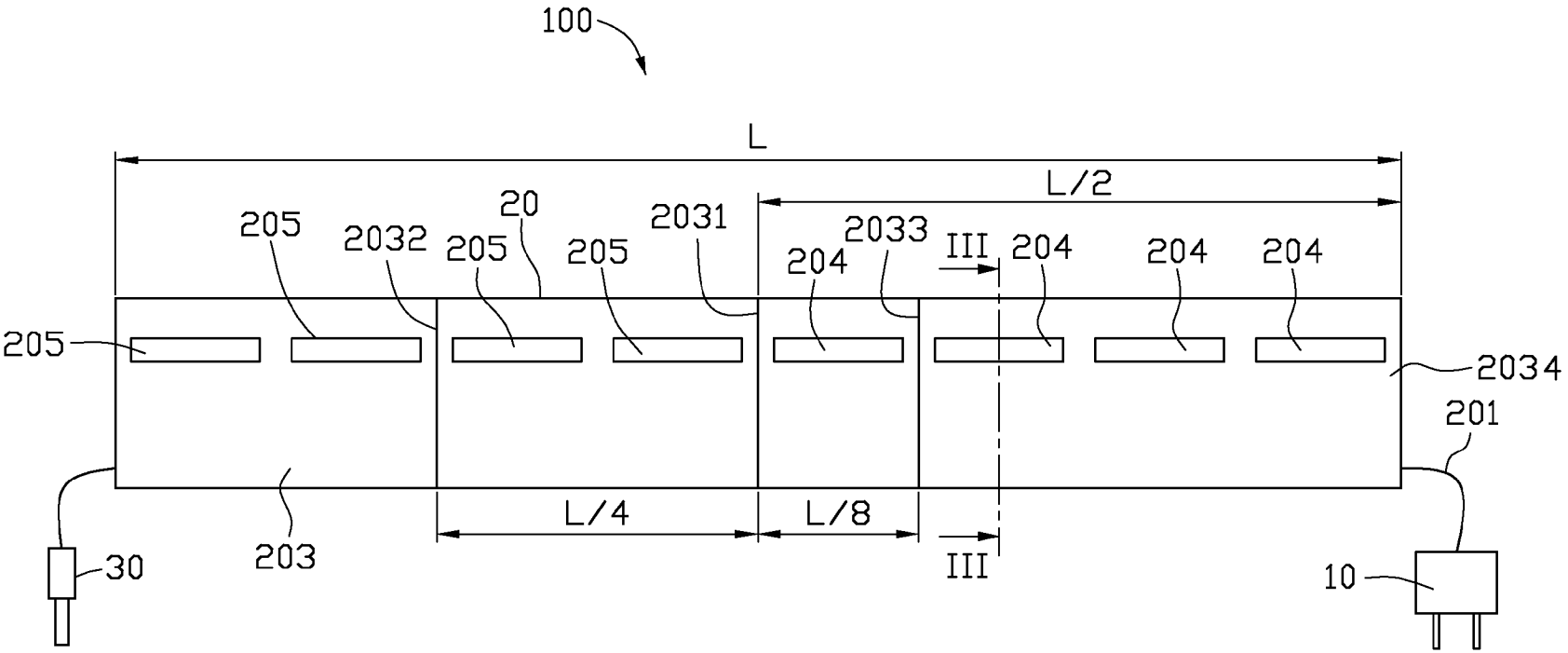
FIG. 1 is a front view of an exemplary embodiment of an electrical connecting device, the electrical connecting device including a foldable electric cord.
Figure 2:
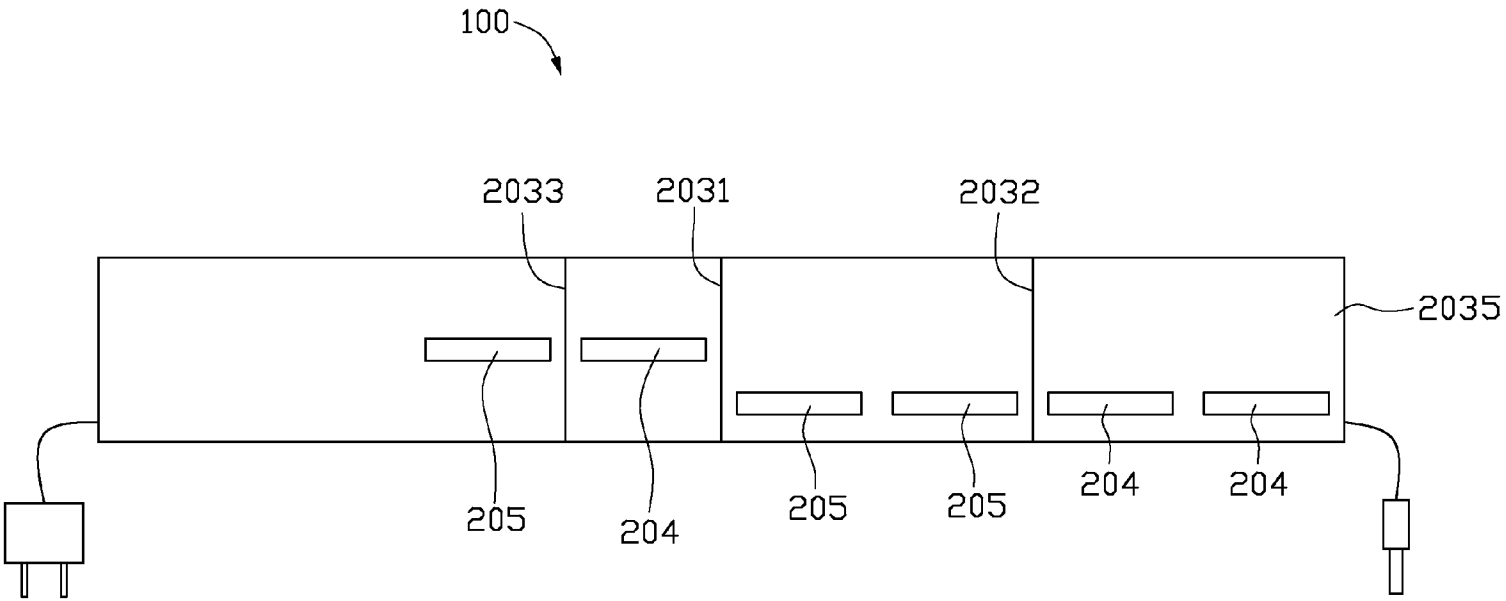
FIG. 2 is a rear view of the electrical connecting device shown in FIG. 1.

FIGS. 1 and 2 show an exemplary electrical connecting device 100 includes a main body 10, a foldable electric cord 20 and a plug 30. In this exemplary embodiment, the electrical connecting device 100 is a charger for a mobile phone (not shown), and the main body 10 is a transformer.

The foldable electric cord 20 includes a flexible insulated strap 203 and a wire 201 in the flexible strap 203. The wire 201 may, e.g., be threaded through the flexible strap 203 or the flexible strap 203 molded around the wire 201. Two ends of the wire 201 are correspondingly connected to the main body 10 and the plug 30.

Figure 3:
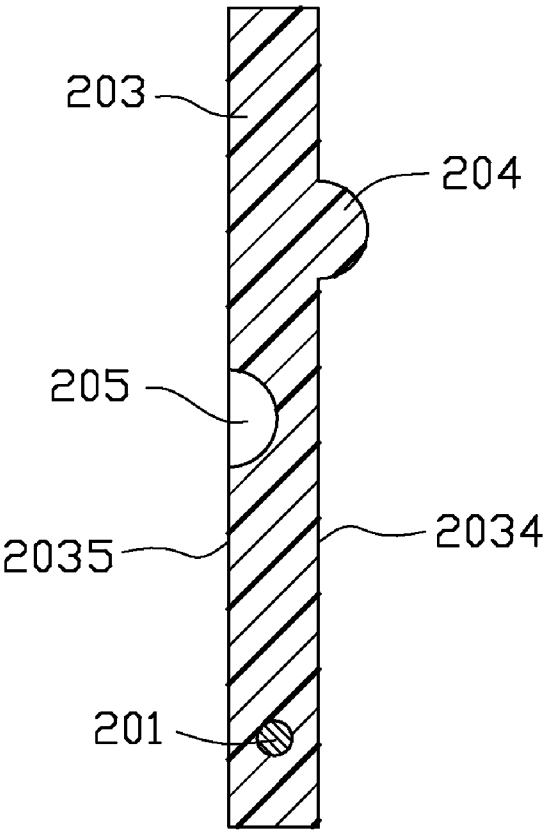
FIG. 3 is a cross-sectional view taken alone line III-III of FIG. 1.

The flexible strap 203 is a flat strip and is made of polymer materials with improved bending quality and high bending endurance. For instance, the flexible strap 203 can be made of polyimide or polyester film. In the exemplary embodiment, the flexible strap 203 defines a first crease 2031, a second crease 2032, and a third crease 2033 parallel to each other. The first crease 2031 is located at a middle portion of the flexible strap 203 perpendicular to an extension direction of the flexible strap 203. L represents the length of the flexible strap 203, thus, the distance between the first crease 2031 and either end of the flexible strap 203 is L/2. The second crease 2032 is on the left side of the first crease 2031, and the distance between the second crease 2032 and the first crease 2031 is L/4. The third crease 2033 is on the right side of the first crease 2031, and the distance between the third crease 2033 and the first crease 2031 is L/8. The flexible strap 203 has a first surface 2034 and a second surface 2035 (in FIG. 3), and the first surface 2034 and the second surface 2035 are on opposite sides of the flexible strap 203. The flexible strap 203 may include four first fixing members 204 and four second fixing members 205 disposed on the first surface 2034 adjacent to an upper margin of the flexible strap 203. The four first fixing members 204 and the four second fixing members 205 are formed on opposite sides of the first crease 2031.

In this exemplary embodiment, the first fixing member 204 is an elongated latching protrusion with an extending direction perpendicular to the first crease 2031. The four first fixing members 204 are spaced apart along an imaginary straight line, and each first fixing member 204 has a length shorter than or equal to L/8. Each second fixing member 205 is an elongated latching groove to elastically receive the first fixing member 204. The flexible strap 203 further includes two first fixing members 204 and two second fixing members 205 disposed on one side of the first crease 2031 on the second surface 2035 adjacent to the lower margin. The two first fixing members 204 and the two second fixing members 205 are formed on opposite sides of the second crease 2032. The flexible strap 203 further includes one first fixing members 204 and one second fixing members 205 disposed on the other side of the first crease 2031 on the second surface 2035 in the middle portion. The one first fixing member 204 and the one second fixing member 205 are on opposite sides of the third crease 2033.

Figure 4:
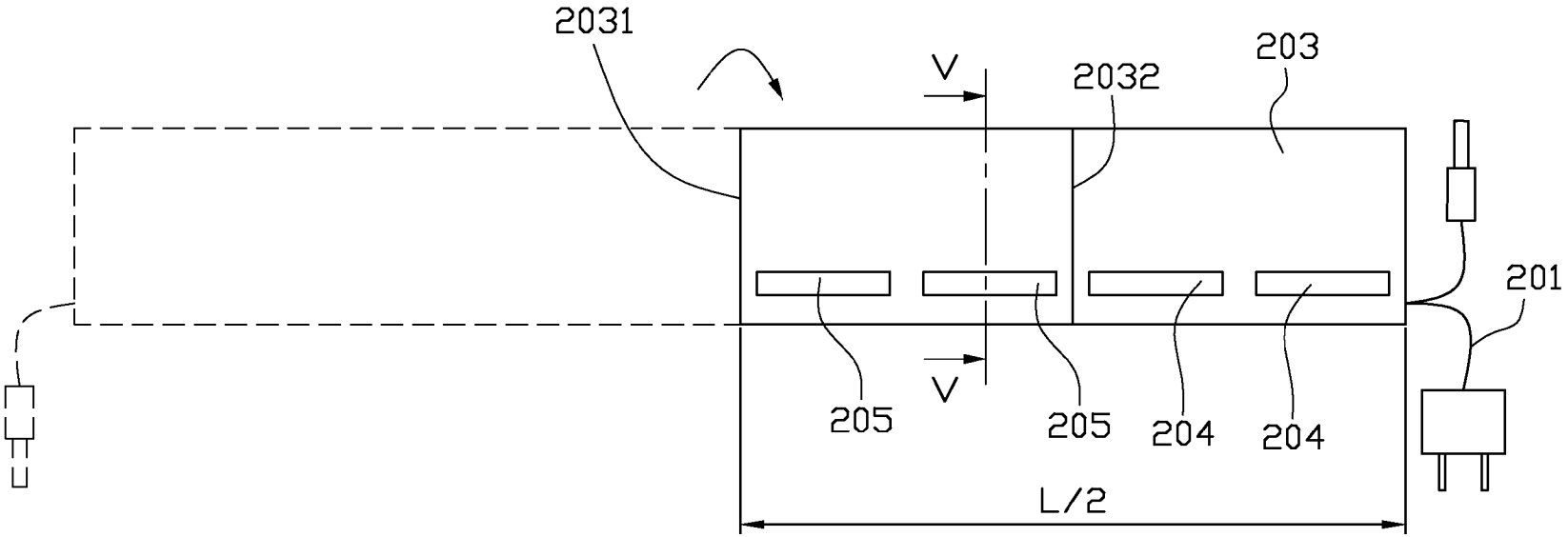
FIG. 4 is a front view of the electrical connecting device shown in FIG. 1 after the foldable electric cord is folded once.
Figure 5:
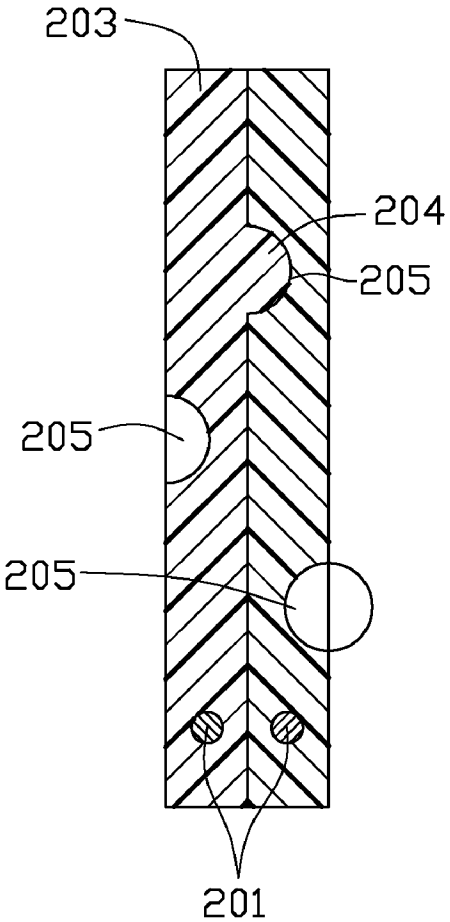
FIG. 5 is a cross-sectional view taken alone line V-V of FIG. 4.
Figure 6:
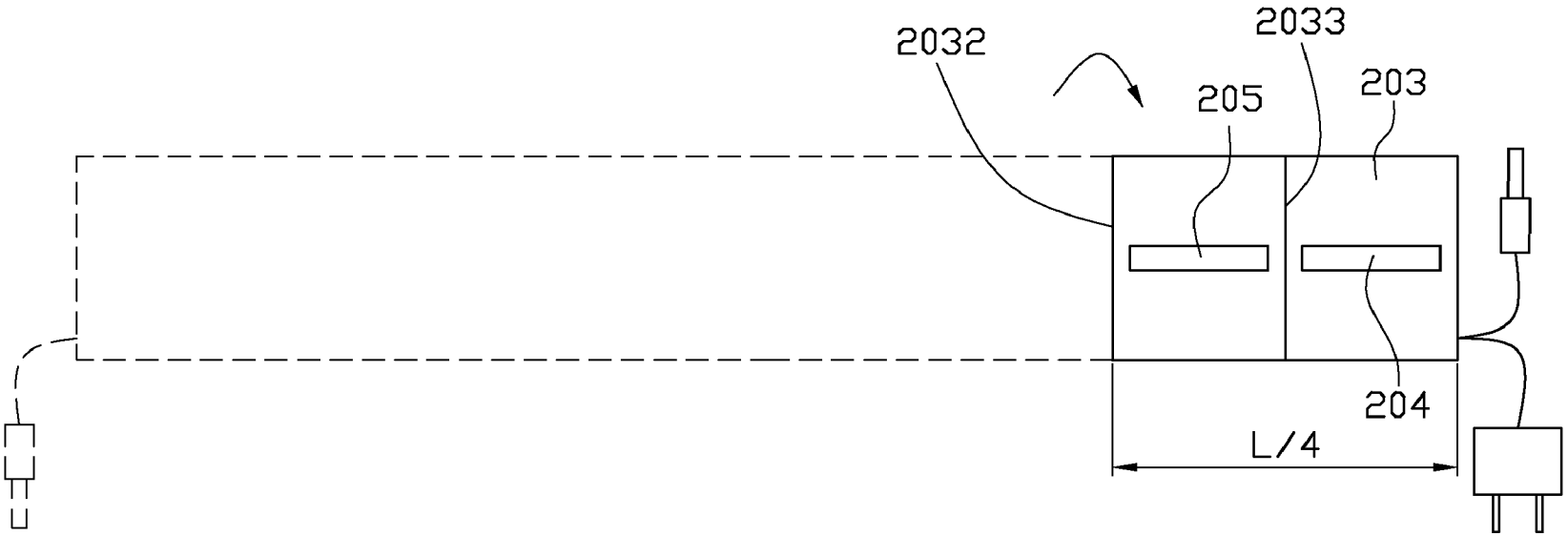
FIG. 6 is a front view of the electrical connecting device shown in FIG. 1 after the foldable electric cord is folded twice.
Figure 7:
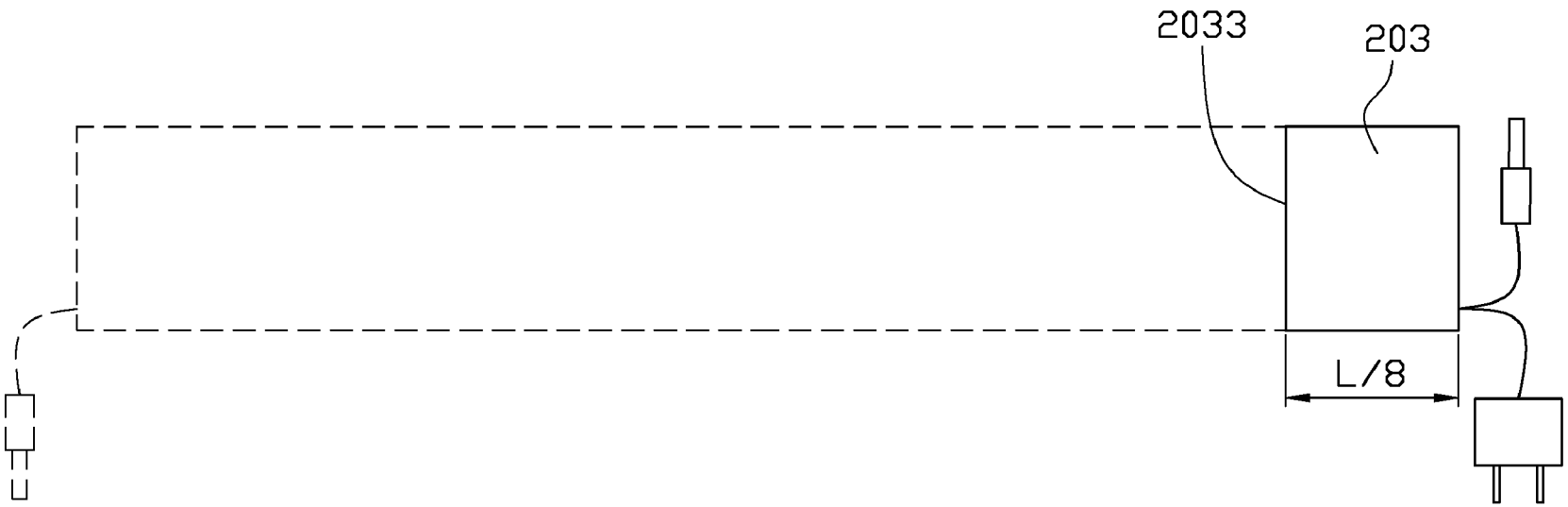
FIG. 7 is a front view of the electrical connecting device shown in FIG. 1 after the foldable electric cord is folded for the third time.

Referring to FIGS. 4 and 5, to shorten the foldable electric cord 20, firstly, the flexible strap 203 is folded along the first crease 2031, and the four first fixing members 204 on the first surface 2034 of the flexible strap 203 are elastically received in the four corresponding second fixing members 205. The length of the foldable electric cord 20 is shortened to L/2 after the foldable electric cord 20 is folded once. Secondly, the foldable electric cord 20 is folded along the second crease 2032, and the two first fixing members 204 on the second surface 2035 are elastically received in the two second fixing members 205 correspondingly. The length of the foldable electric cord 20 is shortened to L/4 after the foldable electric cord 20 is folded twice. Thirdly, the foldable electric cord 20 is folded along the third crease 2033, and the one first fixing member 204 on the second surface 2035 is elastically received in the one corresponding second fixing member 205. The length of the foldable electric cord 20 decreases to L/8 after the foldable electric cord 20 is folded for the third time.

One of the advantages of the foldable electric cord 20 is that, after a number of folds, the foldable electric cord 20 is easily carried and/or stored due to the shortened length. Another advantage is that, because the wire 201 buried in the flexible strap 203 is arranged in a manner parallel with each other when folded, the foldable electric cord 20 is not likely to become twisted and tangled when unfolded. It also provides the electrical connecting device 100 with the longer usage for preventing the wire 201 from being broken and short-circuits.

It is to be understood that, the total foldable count is not limited to three, four or more times are also available, as long as the number of the first and second fixing members 204, 205 increases. Furthermore, the number and distribution of first and second fixing members 204, 205 can be different from described herein.

It is to be understood that, the length or shape of the first fixing member 204 can be less than those of the second fixing member 205. The extension direction of the first and the second fixing member 204,205 is not necessarily perpendicular to the first crease 203 1. For example, it may be parallel to the crease 2031. The shape of the first and the second fixing member 204, 205 is not limited to elongated, for example, they can be circular or triangular.

It is to be understood that, the first and second fixing members 204,205 are not limited to the protrusions and grooves. In another exemplary embodiment, the first fixing member 204 and the second fixing member 205 have opposite magnetisms. The first fixing member 204 and the second fixing member 205 are attracted to each other when the foldable electric cord 20 is folded.

It is to be understood that, the foldable electric cord 20 can be used in other devices, such as headset, mouse, speaker, etc.

It is believed that the present exemplary embodiments and their advantages will be understood from the foregoing description, and it will be apparent that various changes may be made thereto without departing from the spirit and scope of the disclosure or sacrificing all of its material advantages.

What is claimed is:

1. A foldable electric cord, comprising:

a flexible insulated strap; and a wire in the flexible strap;

wherein the flexible strap comprises a first crease located at a middle portion thereof, a second crease parallel to the first crease, a plurality of first fixing members, a plurality of second fixing members corresponding to the first fixing members, a first surface and a second surface opposite to the first surface; four of the first fixing members and four of the second fixing members are disposed on opposite sides of the first crease on the first surface; two of the first fixing members and two of the second fixing members are disposed on opposite sides of the second crease on the second surface; the first fixing members are fixed to the second fixing members to fold the flexible strap for at least two times.

2. The foldable electric cord of claim 1, wherein a distance between the second crease and the first crease is a quarter of the length of the flexible strap.

3. The foldable electric cord of claim 2, wherein the flexible strap comprises a third crease parallel to the first crease, the third crease and the second crease are on opposite sides of the first crease, and one of the first fixing members and one of the second fixing members disposed on opposite sides of the third crease on the second surface.

4. The foldable electric cord of claim 3, wherein a distance between the third crease and the first crease is ⅛ of the length of the flexible strap.

5. The foldable electric cord of claim 3, wherein the four of the first fixing members and four of the second fixing members on the first surface are adjacent to an upper margin of the flexible strap, the two of the first fixing members and the two of the second fixing members on one side of the first crease on the second surface are adjacent to a lower margin of the flexible strap, the one of the first fixing members and the one of the second fixing members on opposite sides of the third crease on the second surface are in a middle portion of the flexible strap.

6. The foldable electric cord of claim 1, wherein each first fixing member is a protrusion, each second fixing member is a groove, and the protrusion is elastically received in the groove when the foldable electric cord is folded.

7. The foldable electric cord of claim 6, wherein each first fixing member is an elongated latching protrusion, each second fixing member is an elongated latching groove, the extension direction of the first fixing members and the second fixing members is perpendicular to the first crease.

8. The foldable electric cord of claim 1, wherein the first fixing members and the second fixing members have opposite magnetisms, and a pair of the first fixing members and the second fixing members are attached to each other when the foldable electric cord is folded.

9. An electrical connecting device comprising:

a main body;

a plug; and a foldable electric cord including a flexible strap and a wire in the flexible strap connecting the main body and the plug; the flexible strap including a first crease located at a middle portion thereof, a second crease parallel to the first crease, a first surface, a second surface opposite to the first surface, a plurality of first fixing members and a plurality of second fixing members corresponding to the first fixing members; at least one of the first fixing members and at least one of the second fixing members disposed on opposite sides of the first crease on the first surface, at least one of the first fixing members and at least one of the second fixing members disposed on opposite sides of the second crease on the second surface; the first fixing members fixed to the second fixing members to fold the flexible strap for at least two times.

10. The electrical connecting device of claim 9, wherein there are four of the first fixing members and four of the second fixing members disposed on opposite sides of the first crease on the first surface, and there are two of the first fixing members and two of the second fixing members disposed on opposite sides of the second crease on the second surface.

11. The electrical connecting device of claim 10, wherein a distance between the second crease and the first crease is a quarter of the length of the flexible strap.

12. The electrical connecting device of claim 11, wherein the flexible strap comprises a third crease parallel to the first crease, the third crease and the second crease are on the opposite sides of the first crease, and one of the first fixing members and one of the second fixing members disposed on opposite sides of the third crease on the second surface.

13. The electrical connecting device of claim 12, wherein a distance between the third crease and the first crease is ⅛ of the length of the flexible strap.

14. The electrical connecting device of claim 12, wherein the four of the first fixing members and four of the second fixing members on the first surface are adjacent to an upper margin of the flexible strap, the two of the first fixing members and the two of the second fixing members on one side of the first crease on the second surface are adjacent to a lower margin of the flexible strap, the one of the first fixing members and the one of the second fixing members on opposite sides of the third crease on the second surface are in a middle portion of the flexible strap.

15. The electrical connecting device of claim 9, wherein each first fixing member is a protrusion, each second fixing member is a groove, and the protrusion is elastically received in the groove when the foldable electric cord is folded.

16. The electrical connecting device of claim 15, wherein each first fixing member is an elongated latching protrusion, each second fixing member is an elongated latching groove, the extension direction of the first fixing members and the second fixing members is perpendicular to the first crease.

17. The electrical connecting device of claim 9, wherein the first fixing members and the second fixing members have opposite magnetisms, and a pair of the first fixing members and the second fixing members are attached to each other when the foldable electric cord is folded.

18. A foldable electric cord, comprising:

a wire; and a flexible insulated strap, the wire in the flexible strap; the flexible strap including a first crease located at a middle portion thereof, a second crease parallel to the first crease, a first surface, a second surface opposite to the first surface, a plurality of first fixing members and a plurality of second fixing members corresponding to the first fixing members; at least one of the first fixing members and at least one of the second fixing members disposed on opposite sides of the first crease on the first surface, at least one of the first fixing members and at least one of the second fixing members disposed on opposite sides of the second crease on the second surface; the first fixing members fixed to the second fixing members to fold the flexible strap for at least two times.

19. The foldable electric cord of claim 18, wherein the flexible strap comprises a third crease parallel to the first crease, the third crease and the second crease are on the opposite sides of the first crease, and one of the first fixing members and one of the second fixing members disposed on opposite sides of the third crease on the second surface.

* * * * *